US006745434B2

(12) United States Patent
Smith et al.

(10) Patent No.: US 6,745,434 B2
(45) Date of Patent: Jun. 8, 2004

(54) CLEANING ATTACHMENT FOR CONVERTING A CLEANING IMPLEMENT TO A MOP

(75) Inventors: James A. Smith, Chatham, MA (US); Hertha Smith, Chatham, MA (US)

(73) Assignee: Watch Hill Harbor Technologies, Chatham, MA (US)

( * ) Notice: Subject to any disclaimer, the term of this patent is extended or adjusted under 35 U.S.C. 154(b) by 124 days.

(21) Appl. No.: 09/917,069

(22) Filed: Jul. 27, 2001

(65) Prior Publication Data

US 2003/0019065 A1 Jan. 30, 2003

(51) Int. Cl.[7] ..... A47L 13/44; A47L 13/10; A47L 13/20

(52) U.S. Cl. ..... 16/247; 15/228; 15/210.1; 15/104.94

(58) Field of Search ..... 15/104.93, 104.94, 15/247, 228, 210.1; D32/50

(56) References Cited

U.S. PATENT DOCUMENTS

| | | | | |
|---|---|---|---|---|
| 960,158 | A | 5/1910 | Cummings et al. | |
| 1,080,572 | A | 12/1913 | McDonald | |
| 1,138,305 | A | 5/1915 | Miller | |
| 1,476,396 | A | 12/1923 | Dickson | |
| 1,929,082 | A | 10/1933 | Simon | |
| 2,221,305 | A | 11/1940 | Chase | |
| 2,269,424 | A | 1/1942 | Bernstein | |
| 2,293,461 | A | 8/1942 | Gougeon | |
| 2,382,205 | A | 8/1945 | Coats | |
| 2,446,814 | A | 8/1948 | Crofton | |
| 2,655,680 | A * | 10/1953 | Geerin | 15/228 |
| 2,709,824 | A | 6/1955 | Hall | |
| 2,733,340 | A | 2/1956 | Wilder | |
| 2,733,470 | A | 2/1956 | Wilder | |
| 2,816,313 | A | 12/1957 | Beck et al. | |

(List continued on next page.)

FOREIGN PATENT DOCUMENTS

| | | |
|---|---|---|
| EP | 02 02 5812 | 4/2003 |
| FR | 2575058 | 12/1985 |

*Primary Examiner*—Robert J. Warden, Sr.
*Assistant Examiner*—Laura C Cole
(74) *Attorney, Agent, or Firm*—Connolly Bove Lodge & Hutz LLP

(57) ABSTRACT

A cleaning attachment for converting a cleaning implement, such as a broom, to a mop includes a flexible cover having end sections interconnected by a central section. Fastening structure secures the end sections together to create an enclosure for the broom head. Reusable mounting structure is provided on the exposed lower outer surface of the central section for engagement with a wipe.

16 Claims, 5 Drawing Sheets

U.S. PATENT DOCUMENTS

| | | | | | |
|---|---|---|---|---|---|
| 2,858,559 | A | | 11/1958 | Carlson | |
| 2,963,731 | A | | 12/1960 | Hoots | |
| 2,999,265 | A | | 9/1961 | Duane et al. | |
| 3,221,356 | A | | 12/1965 | Schirmer | |
| 3,339,220 | A | * | 9/1967 | Barry | 15/233 |
| 3,380,504 | A | * | 4/1968 | Green | 15/247 |
| 3,400,420 | A | * | 9/1968 | Granville et al. | 15/104.93 |
| 3,462,790 | A | | 8/1969 | Lingle | |
| 3,737,938 | A | | 6/1973 | Saltzstein | |
| 3,896,518 | A | | 7/1975 | Von Post et al. | |
| 3,913,164 | A | * | 10/1975 | Semenchuk | 15/210.1 |
| 4,455,705 | A | | 6/1984 | Graham | |
| 4,823,427 | A | | 4/1989 | Gibbs et al. | |
| 4,852,210 | A | | 8/1989 | Krajicek | |
| 4,945,599 | A | | 8/1990 | Flynn | |
| 5,012,544 | A | | 5/1991 | Verry | |
| 5,042,105 | A | | 8/1991 | Buck et al. | |
| 5,094,559 | A | | 3/1992 | Rivera et al. | |
| 5,138,738 | A | | 8/1992 | Nicholson | |
| 5,177,831 | A | | 1/1993 | Wirth | |
| 5,217,787 | A | | 6/1993 | Monahan | |
| 5,280,664 | A | | 1/1994 | Lin | |
| 5,419,015 | A | | 5/1995 | Garcia | |
| 5,525,397 | A | | 6/1996 | Shizuno et al. | |
| 5,709,006 | A | | 1/1998 | Carter, Jr. | |
| 5,953,784 | A | | 9/1999 | Suzuki et al. | |
| 5,964,005 | A | | 10/1999 | Williams et al. | |
| 6,058,548 | A | | 5/2000 | Footer et al. | |
| 6,105,193 | A | | 8/2000 | Williams et al. | |
| 6,380,151 | B1 | | 4/2002 | Masters | |
| 6,579,023 | B2 | | 6/2003 | Kunkler et al. | |
| 2002/0083964 | A1 | | 7/2002 | McKay | |
| 2002/0152569 | A1 | | 10/2002 | Zorzo | |
| 2003/0035679 | A1 | | 2/2003 | Zorzo | |
| 2003/0044569 | A1 | | 3/2003 | Kacher et al. | |
| 2003/0049407 | A1 | | 3/2003 | Kacher et al. | |
| 2003/0095826 | A1 | | 5/2003 | Policicchio et al. | |
| 2003/0110584 | A1 | | 6/2003 | Clare et al. | |

* cited by examiner

CLEANING ATTACHMENT FOR CONVERTING A CLEANING IMPLEMENT TO A MOP

BACKGROUND OF THE INVENTION

For years now, brooms have been used for both interior and exterior floor cleaning procedures. Brooms come in all types and sizes, but the most common is the type that looks like an oversized paint brush (with corn bristles) and the long handle. In particular, the most widely used type broom today on interior floor surfaces is a plastic bristled broom having bristles cut on an angle to facilitate sufficient floor sweeping and has a long handle so the user can stand upright.

A disadvantage of brooms is that they can only sweep up dry soil of a rather large size and have no absorbative ability on dry or wet soils. Recently, new products have been introduced into the "handled goods" market. These products are essentially disposable dust mops that will absorb dust and pet hair on hard surface flooring. These new implements use disposable, dry, nonwoven cloths sized approximately 10" by 12". These dry wipes are attached to a hard, flat, rectangular plastic mop head with an elongated handle. The cloths are discarded when dirty and a new one is attached. A recent variation is a wet wipe version for mopping kitchen and bathroom floors.

If one wants to damp mop or wash the floor the most common thing to do is to purchase another cleaning implement such as a "string mop" or sponge mop to be used with detergent, water and a bucket. Mopping wood flooring requires additional and different cleaning agents.

SUMMARY OF THE INVENTION

An object of this invention is to provide a simple attachment that could be used with a broom or other cleaning implement to accommodate disposable wipes for use with virtually all hard surface flooring, dusting and mopping jobs.

A further object of this invention is to provide such a cleaning attachment which can be easily applied to the broom head covering the bristles and which can readily have either a wet or dry wipe detachably mounted to the attachment.

In accordance with this invention a cleaning attachment for converting a broom to a mop comprises a flexible cover having end sections interconnected by a central section. The cover would be placed around a broom head with the end sections fastened together to form an enclosure around the broom head. The central section would be located below the bottom of the broom head and includes reusable mounting structure on the outer surface of the cover at the central section to detachably mount a wipe to the outer surface below the broom head thereby converting the broom to a mop. The wipe would be detached after one or more uses so that a different wipe could replace the original wipe.

In a preferred embodiment of this invention the mounting structure structure on the outer surface of the central section is in the form of hook members of the known hook/loop VELCRO® construction. A preferred wipe is a needle punched material having loops that would be caught by the hook members on the cover. The wipes could be either wet wipes or dry wipes. The cover could be a flat sheet which when placed around the broom head, forms an open sided enclosure. The size of the flat bottom central section could be increased by folding portions of the end sections and then securing the folded portions to the central section. In a variation of the invention the cover is of a bag type that completely encloses the broom head. If desired, the cover could be impregnated with a cleaning composition.

The attachment could be used for cleaning implements other than the above described broom. For example, the attachment could be fastened to a mop, such as a sponge mop, so that the sponge mop (which ordinarily would be used wet) could be used as a dry mop for dusting purposes. The cleaning implement may also take other forms such as a large industrial/institutional push broom.

THE DRAWINGS

DETAILED DESCRIPTION

Figure 1:
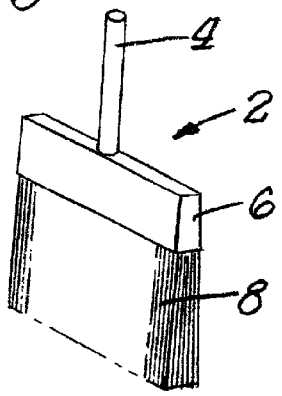
FIG. 1 is a perspective view of a conventional household broom which may be converted to a mop in the practice of the invention.

FIG. 1 shows a conventional broom 2 which can be converted to a mop in the practice of this invention. As shown in FIG. 1 the broom 2 includes an elongated handle 4 and a broom head 6. The broom head has bristles 8 such as corn bristles which may be cut at an angle.

Figure 6:
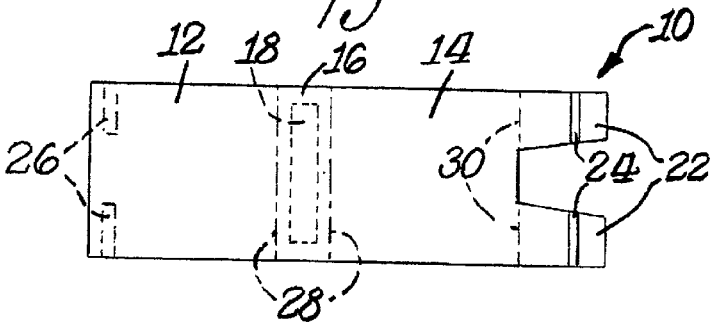
FIG. 6 is a top plan view of the attachment shown in FIGS. 2–3 in its flat condition.

Broom 1 would be used in a customary manner by, for example, sweeping floors. Under certain conditions, however, it would be desirable to convert the broom to a wet or dry mop. This is accomplished by mounting an attachment 10 around the broom head 6 so as to create an enclosure around the broom head. As shown in FIG. 6 the attachment 10 is a cover in the form of a flat flexible sheet which includes a pair of end sections 12,14 connected to each other by a central section 16. Attachment 10 is made of any suitable flexible material as later described. When the attachment is mounted around the broom head 6 the central section 16 of attachment 10 is located below the bottom of the bristles 8 of the broom head 6 and assumes the flat condition of the bottom of the bristles 8. The outer surface of the central section includes reusable mounting structure 18 so that a wipe 20 could be attached to and located outwardly of the central section 16. The wipe 20 in essence forms a mop head which could be used for virtually all hard surface flooring, dusting and mopping jobs. Because the wipe 20 is detachably mounted to the central section 16 and since the same mounting structure 18 on the central section could be reused, either wet or dry wipes can be selectively applied to the attachment 10. Since the attachment 10 is flexible it does not hamper the flexibility of the broom itself.

As shown in FIG. 6 end section 14 of attachment 10 is notched or bifurcated and terminates in a pair of outwardly extending flaps 22,22. The inner surface of flaps 22,22 is provided with fastening structure 24 which could be in the form of VELCRO® hooks or loops. End section 12 includes on its outer surface complementary hooks or loops 26 to provide complementary fastening structure which would engage and be locked to fastening structure 24. Complementary fastening structure 26 could be two aligned strips corresponding to the location of fastening structure 24 on flaps 22,22 or could be a single strip across end section 12.

Figure 2:
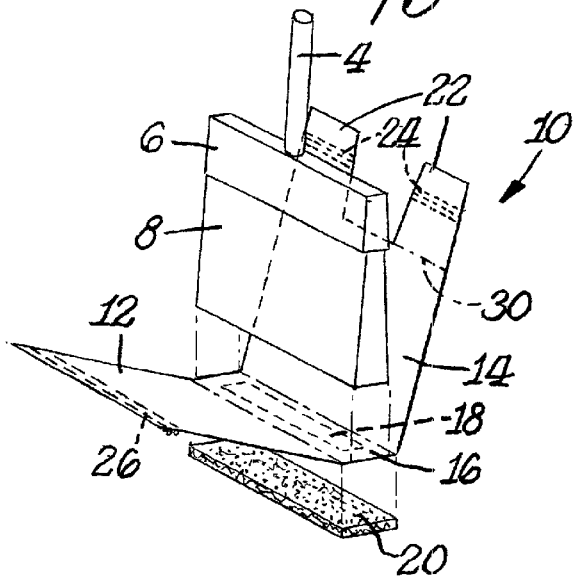
FIG. 2 is an exploded perspective view showing the broom of FIG. 1 in the process of having the cleaning attachment mounted to the broom.
Figure 3:
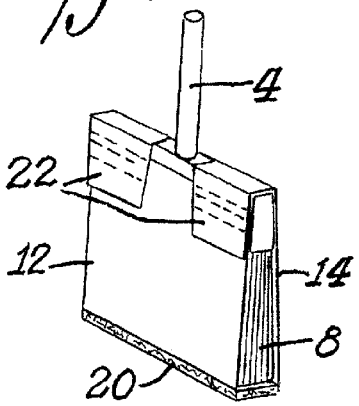
FIG. 3 is a perspective view of the broom of FIGS. 1–2 showing the cleaning attachment fully mounted on the broom.

As shown in FIG. 2 attachment 10 would be wrapped around the broom head 6. End section 12 would be folded along a side of broom head 6. The flaps 22,22 would then be folded over the top of broom head 6 so that its fastening structure 24 is exposed would be located at fastening structure 26. The fastening structure 26 on end section 12 would engage fastening structure 24 on flaps 22,22 to create an open sided enclosure as shown in FIG. 3. The open sided enclosure would have the central section 16 below the bottom of the bristles 8. Central section 16 would have a flat shape with its reusable mounting structure 18 exposed on the outer surface of central section 16.

Figure 4:
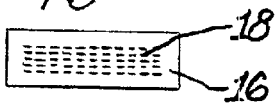
FIG. 4 is a bottom plan view of the cleaning attachment shown in FIGS. 2–3.
Figure 5:
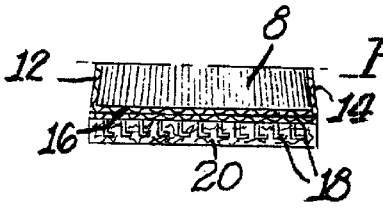
FIG. 5 is a cross-sectional view of a portion of the broom head and attachment shown in FIG. 3.

Any suitable type of reusable mounting structure 18 could be used. In a preferred practice of the invention the mounting structure 18 is the hook portions of velcro material. FIG. 4 thus shows a VELCRO® hook strip 18 to be located on the exposed outer surface of central section 16. The hook structure is particularly suitable to have secure attachment of a wipe 20 where the wipe is made of a known needle punched material. A needle punched material is a known nonwoven fabric which is a dense machine entangled material having a surface of fiber loops and twists. Thus, the hooks of mounting structure 18 would engage the loops of wipe 20. Alternatively, other types of materials as later described can be used for wipe 20 with other types of fastening structures. For example, the wipe material (of a form other than needle punched) may be provided with one or more strips of hook or loop formations from a VELCRO® material which would be engaged with the complementary hooks or loops as the fastening structure 18 on bottom section 16.

Needle punched nonwoven fabric is particularly preferred for wipe 20 because it results in a "hairy" surface in which the hooks of mounting structure 18 can entangle and hold onto the wipe 20. This facilitates moving the broom in a sweeping manner. Since, however, the wipe 20 is on the bottom the broom actually functions as a mop. Moreover, dry needle punched fabric can hold onto dirt and soil (pet hair, etc.) On the other hand pre-moistened needle punched fabric can hold onto cleaning solutions and at the same time release the solution as it is moved over the flooring surface. An integral part of the wipe is the composition of the fibers, i.e. polyester, rayon, cotton, etc. If desired the wipes 20 could be formulated for dry wiping to attract dust and dirt, pre-moistened compositions for kitchen floors, bathroom floors (disinfecting and deodorization) wood floor compositions, mop and shine wipes for waxed floors, "sticky surface" wipes for carpeting to reduce vacuuming, etc.

The attachment 10 and wipes 20 in wet and dry form could be pre-packaged in kit form using any suitable packaging techniques.

In use the consumer would simply attach the attachment 10 to the broom, pull out a suitable wipe from a package and stick the wipe on the bottom or central section of the attachment locating the wipe in the hook area on the bottom. The consumer would then use the broom/mop in a conventional manner. As the broom goes over the floor the attachment holds onto the wipe in an extremely secure manner. The consumer can press on the broom to get at corners, under overhangs, right up close to baseboards, next to appliances, as well as broad areas of open flooring. The bristles 8 of the broom flex and bend to accommodate the flooring surface. Thus, the wipe 20 can be pinpointed or can be used broadly. The resultant converted mop would actually be better than a conventional dirty sponge or a string mop for wet mopping. The invention would avoid the need for dripping buckets of water, etc. For dry mopping the invention would be superior to the known variations previously described where dry nonwoven cloths are attached to a hard, flat, rectangular, plastic mop head because the invention is more flexible and convenient to use. Moreover, the attachment and wipes would be less expensive and take up less shelf space in stores. This would lend itself to higher profit margins.

Preferably, the wipe 20 is made of the same size (i.e. length and width) as the central section 16. If desired, the wipe 20 could be made slightly smaller in either length and/or width or the wipe could be larger in either length and/or width than the central section 16.

If desired, further reusable mounting structure could be located on the outer surface of one or both end sections 12,14 and an oversized wipe 20 could be used which would then be folded against one or both end sections 12 and/or 14 for additional engagement of the wipes with the attachment 10.

If desired, fold lines 28,28 could be provided at the edges of central section 16 to assure, that the central section has a proper width corresponding to the width of the bottom of the broom head bristles 8. Similarly, fold lines 30,30 may be provided to facilitate the folding of the flaps.

It is also to be understood that the end sections 12 and 14 may be secured together by having either the fastening structure 24 of the end flaps 22,22 on the outer surface to engage fastening structure 26 on the inner surface of end section 12 where the flaps would be inside of end section 12 or conversely by having the mounting structure 24 on the inner surface of flaps 22,22 to engage the fastening structure 26 on the outer surface of end section 12, as illustrated in FIG. 3. Thus, either the flaps would be first folded over the broom head and then the end section 12 would be folded outermost against the flaps or the end section 12 would be first folded around the broom head and the flaps would then extend over and be folded against the end section 12.

It is also to be understood that the attachment 10 may include as the fastening structure and the reusable mounting structure fastening elements such as velcro strips located at one or more areas of the attachment. Thus, for example, the central section 16 may have a single VELCRO® strip 18 or may have a plurality of spaced or juxtaposed strips. Similarly, the flaps 22 may have one or more sets of strips which could be either over a wide area or over narrow areas of the flaps and correspondingly the end section 12 could have one or more sets of strips or other fasteners.

When the broom 2 is converted to a mop by attaching a wipe 20 the broom can later be reconverted back to a broom by removing the wipe 20 and attachment 10. Similarly, when the broom is converted to a mop a wipe can be removed and disposed of after a single or multiple uses. The wipe 20 can then be replaced by the same or different type of wipe. Thus a dry wipe could be removed and a wet wipe mounted in its place, or vice versa, or a wet or dry wipe could be removed and replaced by the same type of wet or dry wipe, particularly where the removal is because the prior wipe has become too dirty.

Figure 7:
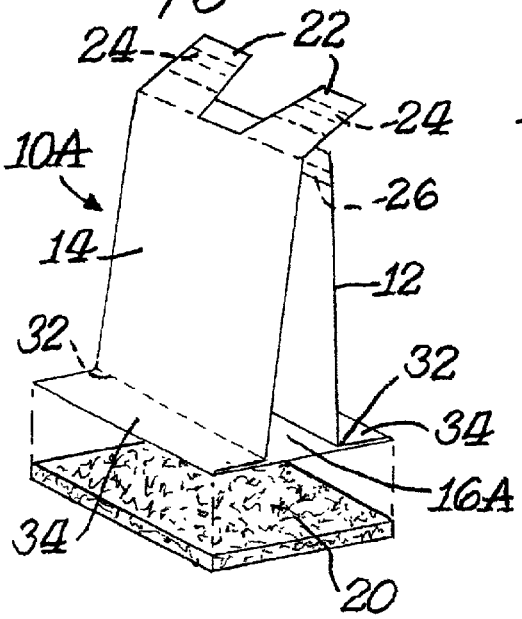
FIG. 7 is an exploded perspective view showing a modified form of attachment in accordance with this invention.
Figure 8:
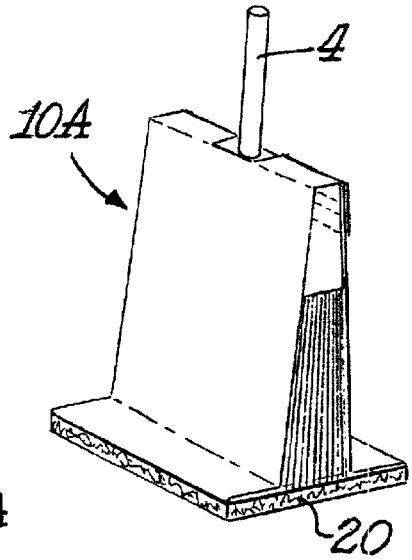
FIG. 8 is a perspective view showing the attachment of FIG. 7 mounted to a broom.
Figure 9:
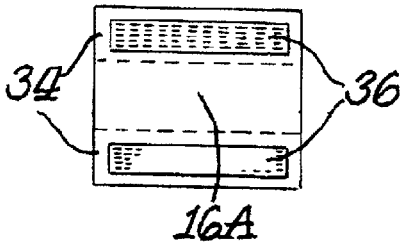
FIG. 9 is a bottom plan view of the attachment shown in FIGS. 7–8.

FIGS. 7–9 illustrate a modified attachment 10A. As shown therein attachment 10A would also include end sections 12,14 with flaps 22,22 extending from end section 14 as previously described. Similarly, fastening structure 24,24 would be provided on flaps 22,22 for engagement with fastening structure 26 on end section 12. Attachment 10A differs from attachment 10 in that the bottom section 16A is made of larger size. This is accomplished by providing folds 32,32 on end sections 12,14 which are secured such as by sewing or heat sealing to the central section 16A thereby creating extended areas 34 on top of central section 16A. This results in a larger size central section and permits the use of larger size wipes 20 to be detachably mounted to central section 16A. As shown in FIG. 9 the reusable mounting structure 36 could be located at the bottom of central section 16A at a location below the extended areas 34.

Figure 10:
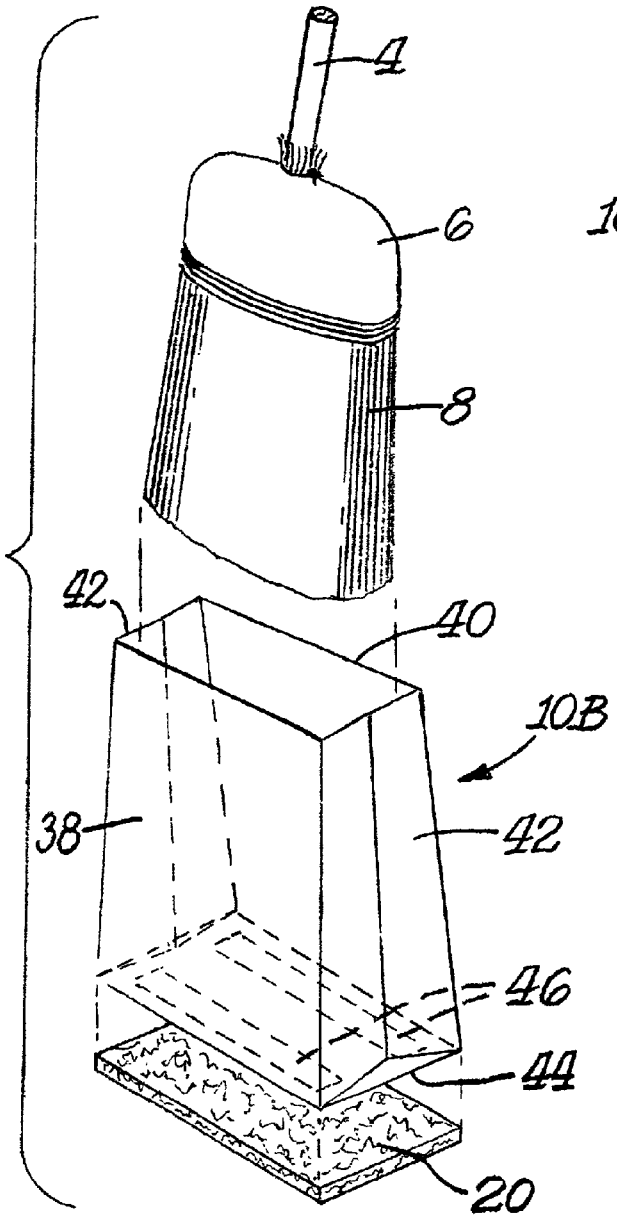
FIG. 10 is an exploded perspective view showing yet another form of attachment being mounted to a broom.
Figure 11:
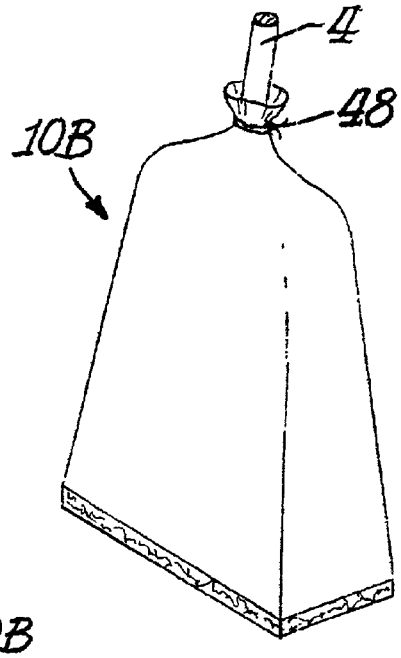
FIG. 11 is a perspective view showing the attachment of FIG. 10 mounted to the broom.

FIGS. 10–11 illustrate yet another form of attachment 10B which is generally in the form of a bag having side walls 38,40 and end walls 42,42 with an open top. The bottom wall 44 would correspond to the previously described central section 16. Bottom wall 44 would include reusable mounting structure 46 which could be in the form of a pair of VELCRO® hook strips for engagement with wipe 20. The bag could be loose fitting or dimensioned to be custom fit for broom head 6. In use the bag would be slid over the broom head 6 to completely cover the bristles 8 and broom head 6. The open end of the bag would then be secured to the broom head in any suitable manner such as by the use of a twist tie 48 which closes the bag around the handle 4. Attachment 108 would be particularly useful with large size brooms. The attachment 10B thus forms an enclosure which completely encloses the broom head. Although FIG. 11 illustrates the use of twist ties 48 as the fastening structure, other types of fastening members could be used including tie members integrally formed on the attachment 10*b*.

The disposable bag or attachment 10B can be made entirely of materials consisting of nonwoven, woven cloth, combinations, etc. and various plastic material, such as polyethylene, polypropylene, PET, etc. designed specifically for dusting floors, walls, etc. The use of the converted broom would provide the ability to reach high corners of a room to remove cobwebs. A user could dust, clean, remove the spiderwebs, etc. and then dispose of the attachment and removed material without much fuss and mess. In addition, the closed bag could contain water activated cleaning compositions that could be activated by moistening under tap water for damp brooming or damp mopping. If desired the central bottom section 16 or 16A of the previously described attachments could also be impregnated with activated cleaning compositions and then activated by moisture from tap water.

The attachment 10B is designed so that it has a flat, yet flexible bottom to match larger size disposable cleaning cloths in either wet or dry form. The flat bottom 44 allows the use of a larger surface area of hooks 46,46 to be applied for holding onto the disposable dusting or wet mopping cloths or wipes 20.

Figure 12:
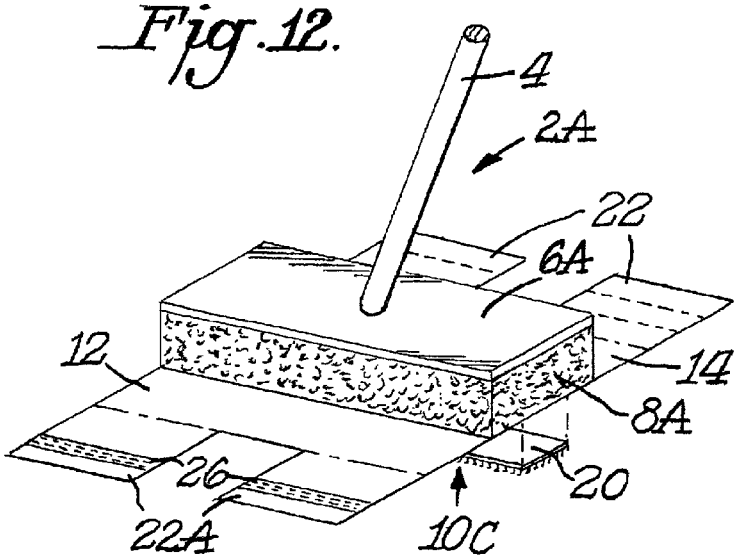
FIG. 12 is a perspective view showing the attachment of this invention used with a sponge mop.
Figure 13:
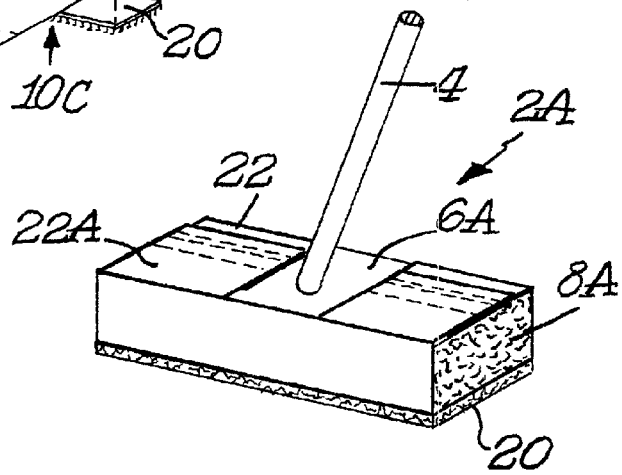
FIG. 13 is a perspective view of the embodiment shown in FIG. 12 with the attachment in its mounted condition.

The invention has been described with regard to FIGS. 1–11 where the cleaning implement is a conventional broom having a broom head with bristles. The invention may be practiced with other types of cleaning implements. FIGS. 12–13 illustrate a cleaning implement in the form of a sponge mop 2A having an elongated handle 4, a head 6A and a sponge 8A as the cleaning portion of the sponge mop. The sponge mop 2A may be provided with any of the aforenoted types of attachments so that, for example, the sponge mop, which is traditionally used wet, could be converted into a dry mop for dusting floors, etc.

FIGS. 12–13 illustrate an attachment 10C similar to attachment 10 for converting the implement or mop to a dry mop. Like reference numerals for attachment 10C are used for like parts in attachment 10. The main differences between attachment 10 and attachment 10C of FIGS. 12–13 is that the end section 12 is also provided with a central notch and outwardly extending flaps 22A,22A. Thus, both sets of flaps 22,22 and 22A,22A would be folded over the head 6A of mop 2A with the outermost flaps being the flaps having the fastening structure on its inner surface. If desired, however, an attachment without two sets of flaps could also be used.

Figure 14:
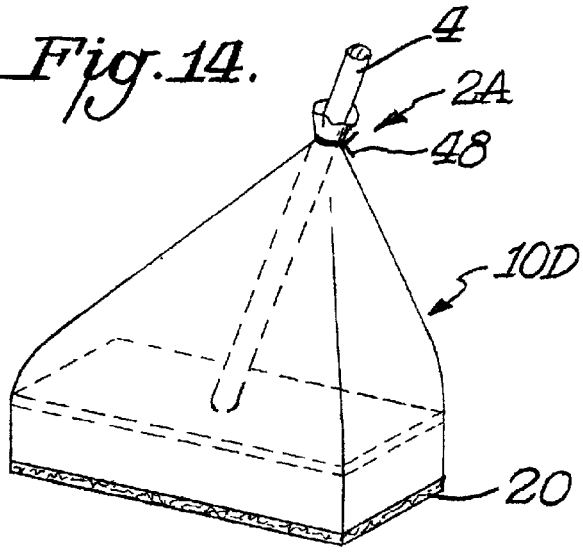
FIG. 14 is a perspective view of a further embodiment of this invention used with a sponge mop.

As noted, any of the previously described type of attachment could be mounted on mop 2A. Thus, FIG. 14 illustrates a bag type attachment 10D similar to attachment 10B which would be mounted over the cleaning end of mop 2A.

It is to be understood, as described with respect to attachment 10B, that the bag type attachment is preferably a loose fitting bag tied at its upper end to the handle of the cleaning implement. The invention may be practiced, however, where the bag type attachment is custom fit by being suitable dimensioned to correspond to the dimensions of the cleaning head of the cleaning implement whether the cleaning implement be a broom, mop or other type of cleaning implement.

Although not illustrated, the sponge mop 2A could also be provided with an attachment similar to attachment 10A where the bottom central section is of extended dimension.

Figure 15:
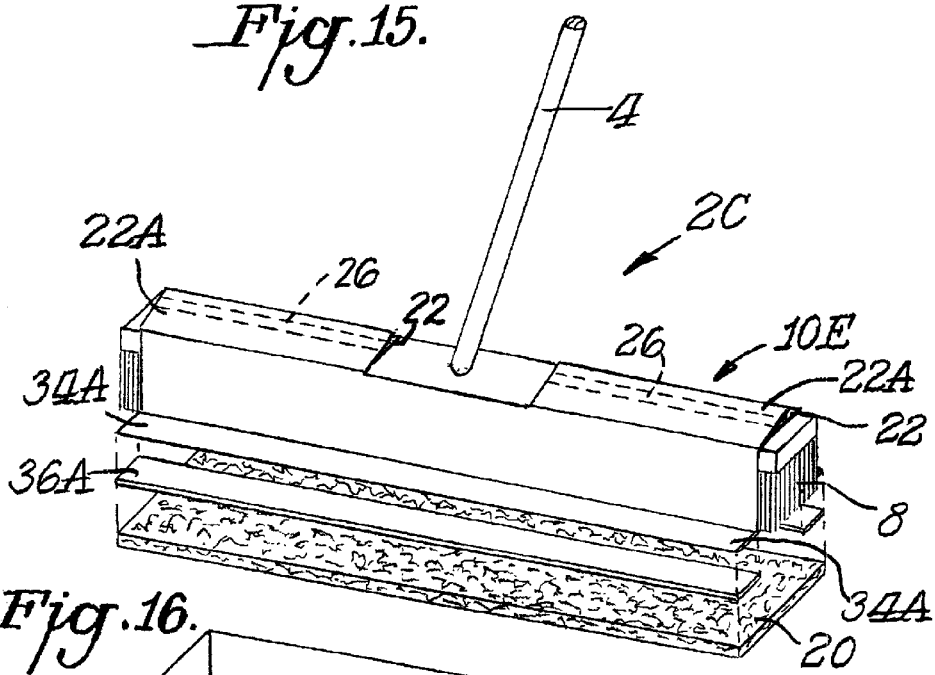
FIG. 15 is an exploded perspective view showing the practice of this invention with a large industrial/institutional broom.

FIG. 15 illustrates a further type of cleaning implement, namely, a large industrial/institutional broom 2C having an elongated handle 4 with a cleaning head 6 and cleaning bristles 8.

The attachment 10E in FIG. 15 is a combination of the attachments 10A and 10C. Thus, as with the attachment 10C attachment 10E includes a set of flaps 22A,22A which fold over flaps 22,22 on top of broom head 6. Attachment 10E also includes folded portions 34A,34A which extend or increase the overall size of the bottom or central portion of attachment 10E. A band or strip of mounting elements 36A such as hook portions may be attached to the bottom side of extended folded portions 34A for securement to dry or wet disposable or limited use wipes 20.

Figure 16:
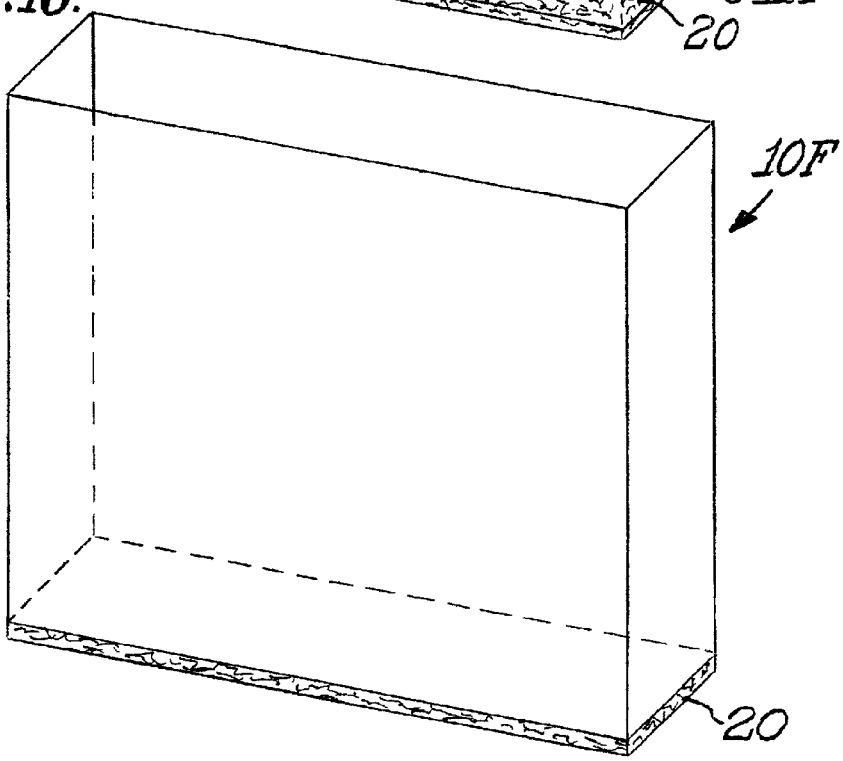
FIG. 16 is a perspective view of an alternative attachment that may be useable with a large industrial/institutional broom.

FIG. 16 illustrates an attachment 10F which may be of a bag type having mounting structure on its bottom surface for attachment to wipe 20. The bag type attachment 10F would be made significantly longer than cleaning head 6 with its bristles 8 so that attachment 10F could extend a sufficient distance up handle 4 to be closed in any suitable manner, such as by twist ties.

Where the invention is used by securing the attachment to a mop it is preferable that the mop is a sponge mop as previously described. It is to be understood, however, that the invention could also be used with other forms of mops, such as a dry mop, particularly where it is desired to utilize the attachment for mounting a wet wipe so that the mop could be used for wet mopping by means of the attachment as well as dry mopping without the attachment. Similarly, where the mop is a wet or is a dry mop, the wipe could be of the same type (i.e., wet or dry) or of the opposite type as the mop itself. Thus, a sponge mop which would ordinarily be used wet could have a wet wipe or a dry wipe mounted to the sponge mop through use of the attachment.

The invention could be practiced with various types of disposable or limited use cleaning cloths which can be dry or wet for various cleaning jobs, such as dry mopping, waxing, damp mopping, scrubbing, etc.

It is to be understood that although the invention has been described by reference to preferred materials, such as velcro type fastening or mounting structure and needle punched wipes, other types of fasteners and materials can be used. For example, wipes 20 could be made nonwoven or woven in single or multiple ply form made from such materials as polyester, rayon, cotton, polypropylene, nylon, fiberglass, rubber, cellulose, polyurethane, polyethylene and PET. The attachment or cover material itself could be made of any suitable flexible material such as woven fabric, nonwoven fabric, plastic, paper, cardboard, wood, leather, metal or combinations thereof. The fastening structure and reusable structure could be hooks and loops as previously described, snaps, buttons, magnets, clasps, etc. Where the invention is practiced by incorporating a cleaning material into the wipe and/or attachment, such cleaning compositions could be disinfectants, surfactants, wood floor cleaners, wax etc. which are either water based, non-aqueous or combinations thereof.

It is also to be understood that various features described with regard to a particular embodiment, may be used with other embodiments where desired and appropriate.

What is claimed is:

1. A cleaning attachment for converting a cleaning implement to a mop, comprising a flexible cover, said cover in its flat unassembled condition having a first end and a second end, a continuous intermediate section between said first end and said second end, said second end being bifurcated to create a pair of spaced outwardly extending flaps with an open area between said flaps, said cover having an inner surface and an outer surface, said intermediate section including a central section between said first end and said second end, fastening structure on said inner surface of said flaps, complementary fastening structure on said outer surface of said first end, reusable mounting structure on said outer surface of said cover, said fastening structure and said complementary fastening structure being located for engagement when said cover is folded around a cleaning head of a cleaning implement to form a closed loop around the cleaning head with said flaps being outwardly of and secured to said first end whereby said open area between said flaps is adapted to accommodate a handle extending outwardly from the cleaning head, said loop having a top and a bottom, and said central section being at said bottom of said loop remote from said secured first end and flaps at said top of said loop with said reusable mounting structure exposed at said outer surface to detachably mount a detached wipe at said bottom of said loop below the cleaning head to convert the cleaning implement to a mop and to detachably remove the wipe after use whereby a different wipe may be selectively mounted to said outer surface.

2. The assembly of claim 1 wherein said central section is flat.

3. The assembly of claim 1 in combination with a wipe, and said wipe extending across said central section at said bottom of said loop when said wipe is attached to said central section, and said central section and said reusable mounting structure of said central section being exposed when said wipe is detached.

4. The assembly of claim 3 in further combination with a cleaning implement having a cleaning head and a handle, and said cover being wrapped around said head.

5. The assembly of claim 3 wherein said reusable mounting structure comprises hook members.

6. The assembly of claim 3 wherein said wipe is made of needle punched material.

7. The assembly of claim 3 in combination with sets of wet and dry wipes.

8. The assembly of claim 4 wherein said cleaning implement is a plastic bristled broom having its bristles cut at an angle.

9. The assembly of claim 4 wherein portions of said end sections are folded against said central section whereby said central section is of an area larger than the area at the bottom of said cleaning head.

10. The assembly of claim 4 wherein said cover forms an open sided cover around said cleaning head.

11. The assembly of claim 3 wherein said wipe has complementary mounting structure for engagement with said reusable mounting structure, said reusable mounting structure being at said central section, and said complementary mounting structure being removed with said wipe when said wipe is detached.

12. The assembly of claim 1 wherein said cover is impregnated with a cleaning composition.

13. The attachment of claim 1 wherein said reusable mounting structure comprises hook members.

14. The assembly of claim 13 wherein said wipe has loop structure engaged by said hook members.

15. The attachment of claim 1 wherein said intermediate section includes fold portions folded against said central section.

16. The attachment of claim 1 wherein said cover is impregnated with a cleaning composition.

* * * * *